US005778081A

United States Patent [19]

Patrick

[11] Patent Number: 5,778,081

[45] Date of Patent: Jul. 7, 1998

[54] ACTIVE NOISE CONTROL USING PHASED-ARRAY ACTIVE RESONATORS

[76] Inventor: William P. Patrick, 60 E. Lake Shore Trail, Glastonbury, Conn. 06033

[21] Appl. No.: 606,460

[22] Filed: Mar. 4, 1996

[51] Int. Cl.[6] ..... G10K 11/16

[52] U.S. Cl. ..... 381/71.5; 381/71.7

[58] Field of Search ..... 381/71, 71.7, 71.5; 415/119; 181/205, 210, 224, 227

[56] References Cited

U.S. PATENT DOCUMENTS

| | | | |
|---|---|---|---|
| 4,371,054 | 2/1983 | Wirt | 181/252 |
| 4,527,282 | 7/1985 | Chaplin et al. | 381/71 |
| 4,947,434 | 8/1990 | Sakai | 381/71 |
| 5,119,427 | 6/1992 | Hersh et al. | 381/71 |
| 5,386,479 | 1/1995 | Hersh | 381/190 |
| 5,386,689 | 2/1995 | Bozich et al. | 381/71 |
| 5,423,658 | 6/1995 | Pla et al. | 381/71 |
| 5,498,127 | 3/1996 | Kraft et al. | 415/119 |

*Primary Examiner*—Forester W. Isen
*Attorney, Agent, or Firm*—Gerald L. DePardo

[57] ABSTRACT

An active noise control system includes sensors 16.26 which detects noise 114 and provides electronic signals to an active noise control (ANC) controller 20. The controller provides electronic anti-noise signals to a speaker 24 which is connected to, and provides acoustic anti-noise into, a plurality of active resonators 120–124. The resonators 120–124 are disposed successively along the propagation direction of the noise 114 and provide time-delayed anti-noise acoustic output signals each of which attenuates a portion of the noise 114. The phasing of the anti-noise signals from the resonators 120–124 may be accomplished by acoustic and/or electronic time delays.

11 Claims, 4 Drawing Sheets

FIG.1
PRIOR ART
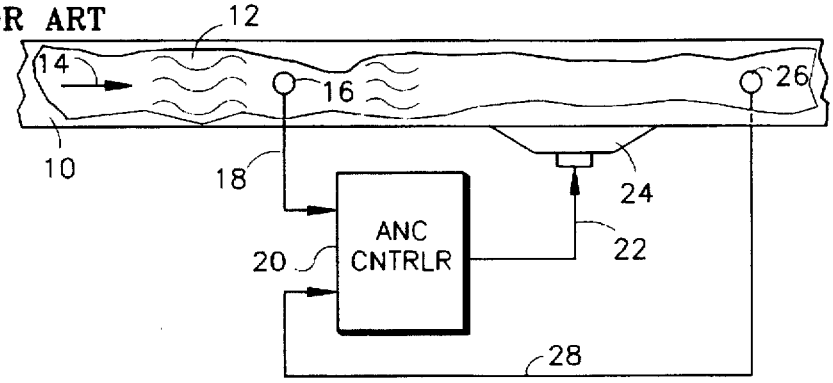
FIG.2
PRIOR ART
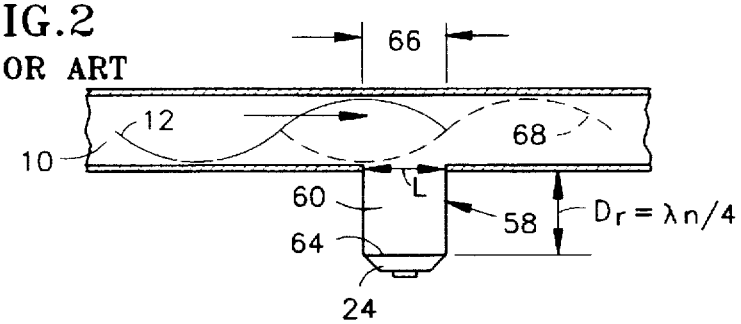
FIG.3
PRIOR ART
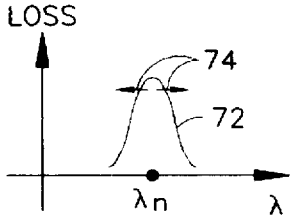
FIG.4
PRIOR ART
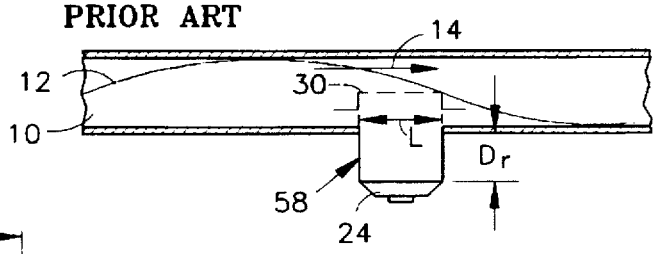
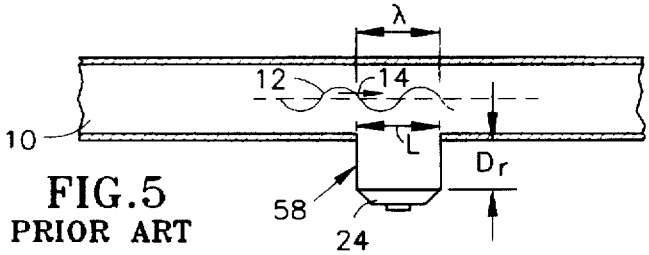
FIG.5
PRIOR ART
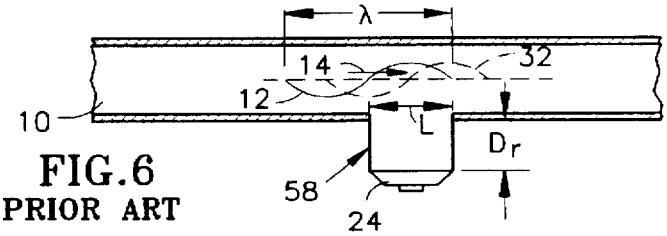
FIG.6
PRIOR ART

ACTIVE NOISE CONTROL USING PHASED-ARRAY ACTIVE RESONATORS

DESCRIPTION

1. Technical Field

This invention relates to active noise control systems employing resonators and more particularly to the use of phased-array active resonators in such systems.

2. Background Art

It is known in the art of active noise (or vibration) control (ANC) systems that such systems are used to electronically sense and cancel undesired noise (or vibration) from noise producing devices such as fans, blowers, electronic transformers, engines, sirens, etc. A typical active noise control system application, such as in an air conditioning duct, consists of a sense microphone (mic) or feed-forward mic to sense noise propagating from a noise source, a speaker located downstream from the sense mic to inject anti-noise into the duct having an appropriate amplitude and phase so as to cancel the noise at the output of the speaker, and an error microphone located downstream of the speaker which senses the amount of cancellation of the noise. The sense mic, the speaker, and the error microphone are all fed to active noise control electronic circuitry or software which monitors the noise signal from the sense mic and generates anti-noise signals to drive the speaker and monitors the amount of error from the error microphone and continuously adjusts the output from the speaker to minimize the noise at the error microphone.

It is also known to mount the speaker on the wall of a resonator, such as a quarter-wave resonator, which is mounted to the duct wall, having a predetermined volume. Use of such a resonator provides some passive cancellation which helps reduce speaker power, and also removes the speaker from the duct wall which protects the speaker from high temperature air flow in the duct and from corrosive effects.

However, a fundamental limitation of such resonator-based prior art active noise control systems is that the bandwidth over which the system can effectively cancel noise is limited by the length of the resonator along the noise propagation path. More specifically, when the resonator speaker is used to cancel the noise, i.e., in the "active" resonator mode, the acoustic wave from the resonator speaker travels along the resonator depth and becomes dispersed over the resonator area. As a result, the resonator produces a substantially constant pulse of acoustic energy (or an acoustic wave pulse) into the duct which is independent of the frequency of the acoustic wave generated by the speaker. Such acoustic wave pulse (or anti-noise pulse) is substantially equal to the resonator length and has an amplitude and phase (i.e., positive or negative) intended to cancel the noise wave over the resonator.

However, the anti-noise pulse can completely cancel noise only if the noise wave is a constant amplitude across the length of the active resonator, i.e., zero frequency or DC (the long wavelength limit). At any non-zero frequency, the noise wave has an amplitude variation across the opening the active resonator, which limits the amount of attenuation that can be achieved by the constant acoustic pulse from the resonator.

More specifically, when the wavelength is long compared to the resonator length, noise attenuation may be nearly perfect. However, as the wavelength ($\lambda$) of the noise approaches the resonator length (L) less attenuation occurs.

In the extreme case, where the noise wavelength ($\lambda$) is less than or equal to the resonator length (L), i.e., $\lambda \leqq L$, the effectiveness of the resonator to cancel the noise approaches zero (it would equal zero only if the speaker were effectively one-dimensional, e.g., rectangular). Also, when $\lambda/2 \leqq L$, the speaker becomes ineffective at certain parts of the noise wave cycle as the noise wave passes by the resonator. Accordingly, the higher the noise frequency (i.e., the shorter the noise wavelength) the smaller the resonator length must be to achieve a given attenuation. Thus, the amount of active attenuation achievable at a given noise frequency is limited by the resonator length.

It is known in the art that the depth of the resonator (or liner thickness) may be reduced and some high frequency active attenuation may be obtained by using a Helmholtz resonator having a predetermined orifice area at the resonator entrance to the duct, such as that described in U.S. Pat. No. 5,119,427, entitled "Extended Frequency Range Helmholtz Resonators", to Hersh et al. The orifice area effectively reduces the active resonator area (or length) from that of a quarter wave resonator. This area reduction allows the resonator volume to be reduced and passively cancel the same noise frequency. Further, the reduced active area provides some increased high frequency noise attenuation (or transmission loss or noise cancellation). However, while such a configuration provides some high frequency noise attenuation because of its small active area, it provides less passive attenuation at the passive resonance frequency for the same reason, i.e., the small active area. Alternatively, if the resonator volume is not decreased, the resonator will be passively tuned to a lower frequency causing it to have better low frequency attenuation.

To increase the passive noise attenuation of the Helmholtz resonator at a given frequency, one may increase the active area or decrease the acoustical flow resistance in the resonator (maximize reactance). The active area may be increased by increasing the effective area of the orifice, e.g., by increasing the number and/or size of the orifices and possibly the length of the resonator. In that case, the resonator loses its advantage over a standard quarter-wave resonator because the active surface length gets large (and thus the active noise cancellation bandwidth decreases).

Conversely, if the flow resistance is reduced, e.g., by reducing the thickness of the orifice wall, the resonator becomes more reactive, causing more of the acoustic energy to be reflected back upstream toward the noise source, thereby reducing the amount of noise absorbed by the resonator. Also, with minimal resistance, the resonator will have a passive frequency response with a high attenuation over a very narrow effective bandwidth, i.e., a high Q resonator, and will be ineffective at passively attenuating broadband noise in the event of failure of the active system components.

Thus, it is desirable to provide an active noise system which provides good noise cancellation at both the upper and lower frequency ranges.

DISCLOSURE OF INVENTION

Objects of the present invention include provision of an active noise control system which provides broadband noise cancellation.

According to the present invention an active noise control system comprises sensing means for detecting noise and for providing noise signals indicative of the noise; noise control means responsive to the noise signals and for providing electronic anti-noise signals; a plurality of active resonators;

actuator means responsive to the electronic anti-noise signals and disposed on the resonators for providing acoustic anti-noise signals into the resonators; and the resonators being disposed successively along the propagation direction of the noise and each providing time-delayed anti-noise acoustic output signals having a time delay between output signals from any two of the resonators being substantially equal to the propagation time of the noise between the two resonators, such that each of the output signals attenuates a portion of the noise.

According further to the present invention, at least one of the resonators comprises a Helmholtz resonator. According still further to the present invention, at least one of the resonators has a predetermined depth which provides the time delay of a corresponding one of the anti-noise output signals. Still further according to the present invention, the actuator means comprises a single acoustic actuator which provides the acoustic anti-noise signals to each of the resonators.

The present invention represents a significant improvement over the prior art by providing broadband active noise cancellation utilizing a phased-array of active resonators, such as active Helmholtz resonators. The invention allows active noise control systems to perform better actively because the amount of active attenuation at a given noise frequency is no longer limited by overall resonator length. In fact, the amount of active attenuation of a given noise frequency actually increases with resonator array length, instead of decreasing (as in the prior art). Thus, the resonator length may be as long as desired. The invention also improves passive resonator performance because the passive attenuation of the phased resonator array is proportional to the length of resonator array, i.e., the resonator array behaves as a "point reacting" resonator (or liner). Also, the invention may use a single speaker which simultaneously drives all the phased array resonators, thereby allowing for reduced speaker and controller hardware.

Further, the amount and kind of passive attenuation (resistive or reactive) may be tailored to the application. In particular, the system may provide significant passive high Q attenuation in the event of failure of the active system components. Alternatively, the system may be designed with a high resistance (low Q) design, thereby providing a broad band passive low Q attenuation. Further, the invention allows for elimination of some or all of the purely passive liners used for attenuating high frequency noise, thereby reducing cost and size.

The foregoing and other objects, features and advantages of the present invention will become more apparent in light of the following detailed description of exemplary embodiments thereof as illustrated in the accompanying drawings.

BRIEF DESCRIPTION OF DRAWINGS

FIG. 1 is a schematic block diagram of a prior art active noise control system for an air duct.

FIG. 2 is a side view of a prior art active noise control system using a quarter-wave resonator.

FIG. 3 is a graph of variable transmission loss (or noise cancellation) versus wavelength for a prior art active noise control system.

FIG. 4 is a side view of the prior art active noise control system of FIG. 2 showing noise having a wavelength much larger than the resonator length.

FIG. 5 is a side view of the prior art active noise control system of FIG. 2 showing noise having a wavelength equal to the resonator length.

FIG. 6 is a side view of the prior art active noise control system of FIG. 2 showing noise having a wavelength equal to twice the resonator length.

BEST MODE FOR CARRYING OUT THE INVENTION

Figure 7:
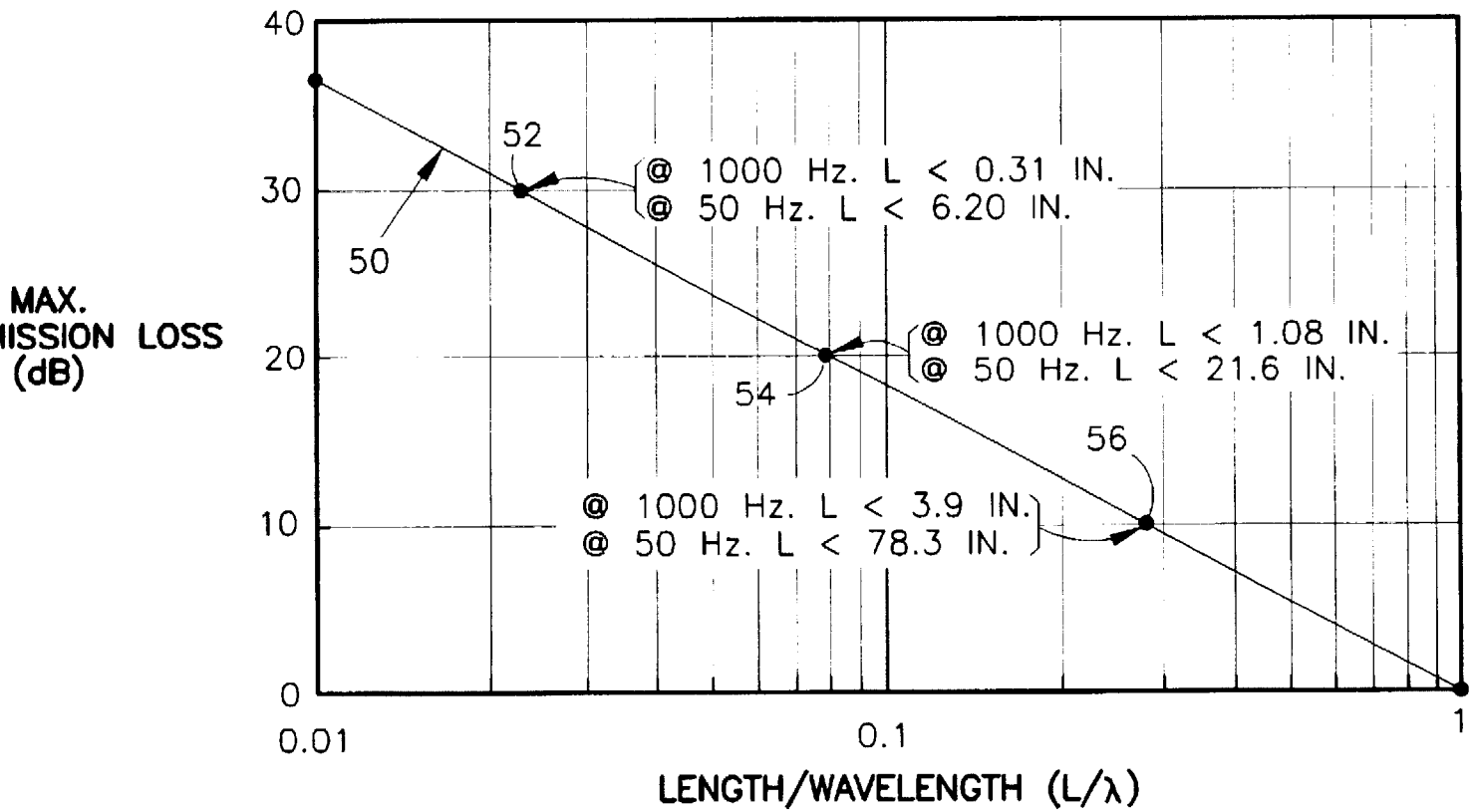
FIG. 7 is a graph of maximum transmission loss versus the ratio of resonator length to noise wavelength.

Referring to FIG. 1, a prior art active noise control system for an air conditioning duct, comprises an air duct 10 along which noise waves 12 propagate in a direction 14. A sense microphone 16 detects the noise 12 and provides an electrical signal on a line 18 to an Active Noise Control(ANC) controller 20. The controller 20 provides an electrical signal on a line 22 to a speaker 24 mounted to the wall of the duct 10. The speaker 24 produces sound waves (anti-noise) of the appropriate amplitude and phase so as to cancel the noise waves 12, such that the noise downstream of the speaker is substantially eliminated. An error microphone 26 located downstream of the speaker 24 senses any noise which is not canceled by the anti-noise. The error microphone 26 provides an electrical signal on a line 28 to the ANC controller 20 to allow the controller 20 to fine tune the output signal on the line 22 to the speaker 24 so as to drive the noise at the error microphone 26 to zero and thus substantially eliminate the noise in the duct downstream of the speaker 24.

The controller 20 is a well known active noise control controller having known electronic circuits and/or software to provide the functions described herein. The details of the controller 20 are not critical to the present invention.

Referring now to FIG. 2, it is also known in the art of noise cancellation to use a quarter-wave side-branch resonator 58 to cancel the noise 12 at a predetermined wavelength. In particular, a passive side-branch resonator comprises a resonator cavity 60, having a predetermined volume (depth (Dr)×cross-sectional area (A)). The cross-sectional area for a rectangular resonator is length (L)×width (W) into the page (not shown), and for a cylindrical resonator is $\pi d^2/4$, where d is the diameter of the cylinder. In a standard side-branch resonator the resonator depth Dr is set to $\lambda/4$ (hence the name "quarter-wave" resonator) where $\lambda$ is the wavelength of the noise to be canceled. In particular, as the noise wave 12 passes across the resonator cavity 60, a portion 66 of the wave 12 enters the resonator 60, travels the length L of the resonator 60, reflects off the bottom (or back) wall 64 of the resonator, travels the length L of the resonator again, and reenters the duct 10 phase-shifted by $\lambda/2$, i.e., $2\times\lambda/4$. When the portion 66 reenters the duct 10, the original wave 12 has now propagated by $\lambda/2$ as indicated by a dashed line 68, and the region 66 of the original wave 12 substantially cancels the wave 68 over the region 66. The amount of cancellation will depend on the length L of the resonator as compared to the noise wavelength $\lambda$, as is known.

Thus, the quarter-wave side-branch resonator 58 provides a $\lambda/2$ or 180° phase-shifted signal of the original noise wave, thereby causing passive cancellation of the input noise wave at a predetermined fixed wavelength.

Instead of the back wall 64 being a solid wall, if the speaker 24 is placed at the end of the resonator 60, the depth Dr of the resonator 60 becomes variable, thereby creating an active resonator. Accordingly, by varying voltage signals provided to the speaker 24, the back wall 64 exhibits a velocity which changes the amplitude and phase of the wave reflected from the back wall 64, thereby changing the effective depth of the resonator and thus changing the effective value of $\lambda/4$, and accordingly changing the resultant value of the noise wavelength $\lambda$ which will be canceled by the resonator.

Referring to FIG. 3, a curve 72 is indicative of the transmission loss or noise attenuation provided by the resonator 58. When the speaker 24 is utilized as the bottom wall 64, the peak transmission loss wavelength $\lambda_n$ can be adjusted by varying the velocity and phase of the bottom wall, as indicated by arrows 74.

Referring now to FIG. 4, at the speaker face, acoustic wave pulses vary in size due to speaker dynamics. However, due to dispersive effects of the resonator on speaker sound, the resonator length L produces a pulse 30 of acoustic energy, either in the positive or negative direction, which attempts to cancel the noise wave 12 in the duct 10. If the wavelength ($\lambda$) of the noise wave 12 is much larger than the resonator length L, the acoustic sound pulse 30 produced by the resonator 58 will substantially cancel the noise wave 12 because the noise wave 12 appears to be a substantially constant acoustic noise wave across the resonator opening.

Referring now to FIG. 5; however, if the wavelength $\lambda$ of the noise wave 12 is less than or equal to the resonator length L (i.e., $\lambda \leqq L$), the acoustic pulse produced by the resonator will not cancel the wave 12 but will merely offset the DC level of the wave 12.

Referring now to FIG. 6, if half the wavelength $\lambda$ of the noise wave 12 is less than or equal to the resonator length L, i.e., $\lambda/2 \leqq L$, the resonator also becomes ineffective for canceling at least a portion of the noise wave 12. In particular, the acoustic pulse from the resonator may cancel portions of the wave 12 when aligned as indicated by the solid line 12 in FIG. 6. However, as the wave 12 propagates to the position of a dashed line 32, the sound pulse from the resonator will not cancel the wave 12 but merely shift its DC level. Thus, the resonator becomes completely ineffective at certain parts of the noise wave cycle and the maximum effectiveness of the ANC system averaged over a noise wave cycle will likely not exceed about 5 dB. Accordingly, the higher the noise frequency (i.e., the shorter the noise wavelength) the smaller the resonator length L must be to achieve a given attenuation. Alternatively stated, the amount of active attenuation achievable at a given noise frequency is limited by the resonator length.

More specifically, referring now to FIG. 7, a curve 50 illustrates the aforementioned relationship between active resonator length L, noise wavelength $\lambda$ and noise attenuation in a graph of maximum transmission loss (or attenuation) versus the ratio of active resonator length L to the noise wavelength $\lambda$. The curve 50 is substantially a straight line when plotted on a log graph.

In particular, if 30 dB attenuation (or transmission loss) is desired and the noise frequency (f) is 50 Hz ($\lambda$=c(speed of sound)/f=1135(ft/sec)/30 Hz=37.8 ft; or 345.95(m/sec)/30 Hz=11.53 meters), the active resonator length L should be less than or equal to about 6.2 inches (15.75 cm), as indicated by a point 52 on the curve 50. Similarly, if 30 dB attenuation is required for noise at 1000 Hz ($\lambda$=1.14 ft or 0.347 meters), the active resonator length L should be less than or equal to about 0.31 inches (0.7874 cm) as also indicated by the point 52 on the curve 50.

If 20 dB attenuation is desired of 50 Hz noise, the active resonator length L should be less than or equal to about 21.6 inches (54.86 cm), and for 1000 Hz noise, the resonator length L should be less than or equal to about 1.08 inches (2.74 cm), as indicated by a point 54 on the line 50. Further, if 10 dB attenuation is desired of 50 Hz noise, the resonator length L should be less than or equal to about 78.3 inches (198.88 cm), and for 1000 Hz noise the resonator length L should be less than or equal to about 3.9 inches (9.9 cm), as indicated by a point 56 on the curve 50. Thus, the higher the noise frequency (i.e., the smaller the noise wavelength), the smaller the resonator length L should be in order to provide effective attenuation. Also, the greater the amount of attenuation desired, the smaller the resonator length L should be for a given noise frequency.

Also, the curve 50 shows that when the wavelength of the noise $\lambda$ is equal to (or greater than) the resonator length L, and thus $L/\lambda \geqq 1$, the transmission loss or noise attenuation is zero. Also, for frequencies at which $\lambda/2 \leqq L$ (or $L/\lambda \geqq 0.5$), the system becomes substantially ineffective (less than about 5 dB attenuation) as discussed hereinbefore.

Figure 8:
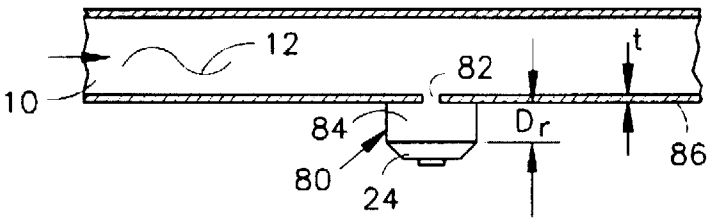
FIG. 8 PRIOR ART
FIG. 8 is a side view of a prior art active noise control system using a Helmholtz resonator.

Referring now to FIG. 8, a Helmholtz resonator 80 is similar to the side-branch resonator 58 of FIG. 2 except that an orifice 82 exists along the duct 10 at the entry point of the resonator. As is known in the art of Helmholtz resonators, the passive frequency at which the Helmholtz resonator is tuned is determined by the following equation:

$$F=(c/2\pi)\ (\sigma A/Vt')^{1/2} \qquad \text{Eq. 1}$$

where F is the frequency of the noise to be passively canceled, c is the speed of sound, A is the cross-sectional area of the resonator taken along a plane perpendicular to the resonator length L, $\sigma$ is the percent of the opening of the orifice 82 as compared to a complete opening shown in FIG. 2, V is the volume of the resonator cavity 84 (cross-sectional area A×resonator depth Dr), for rectangular resonators, A is length (L)×width 30 (into page) and for cylindrical resonators, A is $\pi d^2/4$, where d is the diameter of the cylinder, and t' is t (duct wall or plate thickness or depth of the orifice 82)+a resonator end correction. Eq. 1 is a Helmholtz resonator approximation which applies provided the thickness t of the duct wall 86 through which the orifice 82 exists is larger than the diameter of the orifice 82, as is known. It is also known that $F=c/\lambda$.

Thus, if the orifice 82 represents a 11% reduction in the cross-sectional area, $\sigma$=0.11, the resonant wavelength $\lambda$ is reduced by 0.33 (or ⅓) from a fully open cavity entrance, i.e., a=1 (ignoring changes in the end correction term). Accordingly, if the desired noise cancellation is the same as that provided by the quarter-wave resonator 58 of FIG. 2, the depth Dr of the Helmholtz resonator 80 can be reduced by a factor of 3 to cancel the same noise wavelength as in FIG. 2. Consequently, the Helmholtz resonator 80 allows for a smaller resonator depth Dr to passively cancel the same frequency as that without the Helmholtz resonator orifice 82.

If the speaker 24 is affixed to the bottom end of the resonator 84 of FIG. 8, a similar variation in resonance frequency is exhibited as that shown in FIG. 3. Such a design is discussed in U.S. Pat. No. 5,119,427, entitled "Extended Frequency Range Helmholtz Resonators", to Hersh et al.

Also, in that case, the active length of the resonator is approximately the diameter of the orifice 82. As such, the Helmholtz resonator can actively cancel higher frequencies than the quarter wave resonator, and thus the bandwidth of the system has been increased by using a Helmholtz resonator. While the Helmholtz variable resonator design of FIG. 8 provides a tunable resonator with a small resonator depth Dr, the amount of passive attenuation at lower frequencies is much less, due to the small orifice size. Thus, the variable Helmholtz resonator does not provide significant broadband attenuation of noise.

Figure 9:
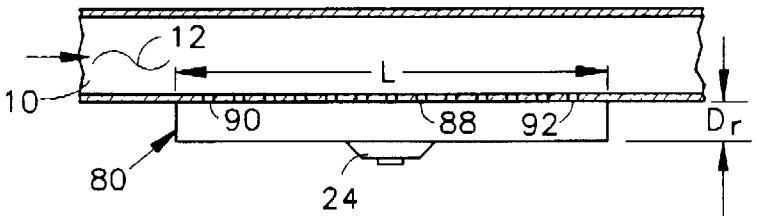
FIG. 9 PRIOR ART
FIG. 9 is a side view of a prior art active noise control system using a Helmholtz resonator with increased resonator length and increased active area.

Referring to FIG. 9, one known way to improve passive attenuation of a Helmholtz resonator is to increase the resonator length L and add more holes along the length L, thereby increasing the active area. However, in that case, the passive noise attenuation is not improved in proportion to the increased length L. In particular, such a configuration becomes a "non-point reacting" liner or a "distributed reacting" liner (or resonator), such that sound may enter the resonator at a first hole 90 and travel along the resonator length L and then exit from a second hole 92, thereby exhibiting an unattenuated acoustic path, which limits the effectiveness of the resonator.

Figure 10:
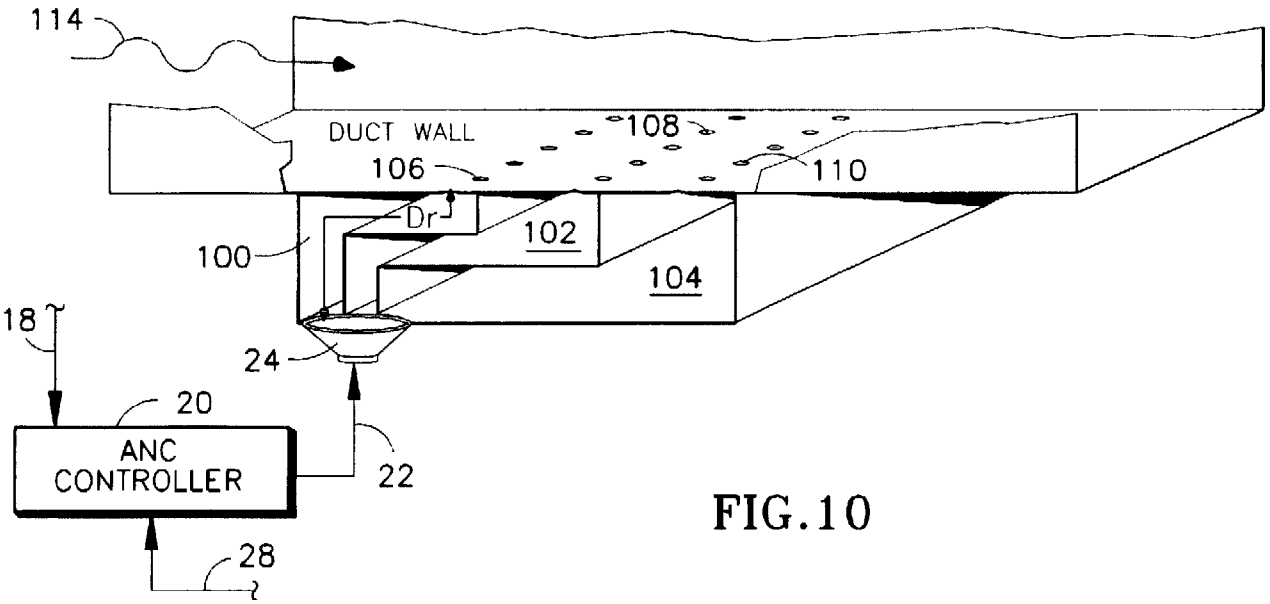
FIG. 10 is a cutaway perspective view an active noise control system having three phased-array active Helmholtz resonators, in accordance with the present invention.

Referring now to FIG. 10 of the present invention, the limitation on the amount of transmission loss for a given resonator length L shown in FIG. 7 is avoided by providing a phased-array of Helmholtz resonators along a duct wall. In particular, the speaker 24 drives three Helmholtz resonators 100,102,104, simultaneously. Also, the resonator 100 has a plurality of orifices (or orifice array) 106, the resonator 102 has an orifice array 108, and the resonator 104 has an orifice array 110.

The cross-sectional area of each of the orifice arrays 106–108 are sized with the volumes of the respective resonators 100–104 such that the three resonators 100–104 all have the same passive resonant frequency. Also, the depth Dr of each of the resonators 100–104 is set such that the noise output from the speaker 24 is time delayed such that it reaches the array orifices 106 of the resonator 100 first, then the array orifices 108 in the resonator 102, and then the array orifices 110 in the resonator 104.

More specifically, depth Dr of the resonators 100–104 are sized such that the time delay between the output signals from the orifice array 106 and the orifice array 108 equals the propagation time for a noise wave 114 to travel from the array 106 to the array 108. A similar spacing exists between the orifice arrays 108,110. Also, this time delay exists between output signals from any two of the resonators 100–104. Accordingly, the acoustic output signals from the resonators 100–104 are acoustically time delayed (or phased) such that the noise wave 114 of a predetermined wavelength passing over the first orifice array 106 is attenuated by a predetermined amount, and then when the wave 114 passes over the orifice array 108 it is attenuated further, and when it passes over the orifice array 110, it is attenuated still further.

Figure 11:
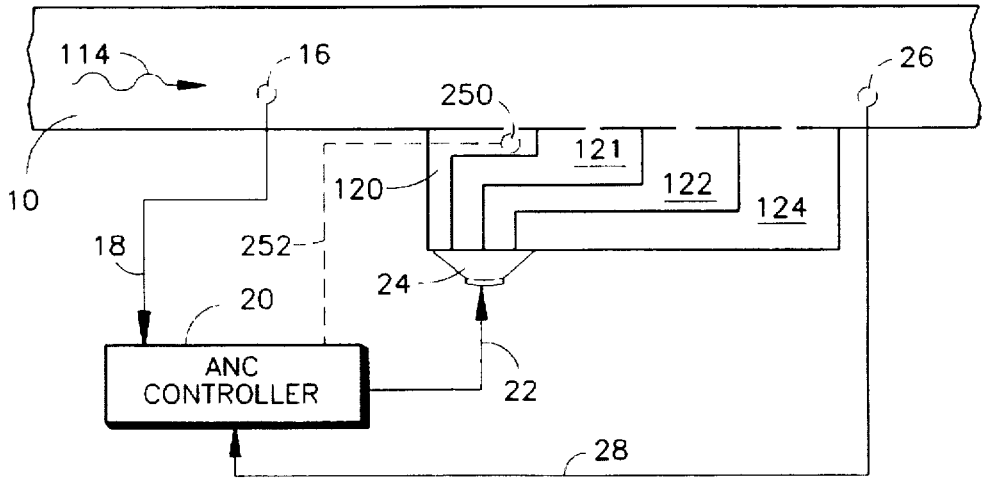
FIG. 11 is a side view of an active noise control system having four phased-array active Helmholtz resonators, in accordance with the present invention.

More or less resonators may be used if desired, such as that shown in FIG. 11 where four resonators are used 120,121,122,124. Also, more than one row (into the page) of orifices may be used for each resonator. Also, the shape of the speaker 24 may be any desired shape, e.g., round, square, rectangular, etc. Further, the single speaker 24 may be replaced by a plurality of speakers all electrically connected together and driven simultaneously, to provide acoustic signals to the resonators 120–124.

Referring to FIG. 11, instead of using the invention in a system which employs a sense and an error microphone connected to the controller 20, it should be understood that the invention will work with any active noise sensing configuration, such as a system which employs no feedforward sensors and a single feedback sensor at or near the output of the resonator array, e.g., a tight coupled monopole system or co-located system.

Alternatively, an error microphone 250 may be placed within the first resonator 120 of the resonator array near the output of the resonator 120. In that case, the mic 250 provides a signal on a line 252 to the controller 20 indicative of the noise cancellation (i.e., the error), and the controller 20 would act as a feedback controller and provide signals to the speaker 150 so as to minimize the acoustic pressure (and thus maximize the acoustic particle velocity) at the output of the resonator 120, such as that described in US Pat. No. 4,527,282, entitled "Method and Apparatus for Low Frequency Active Attenuation", to Chaplin et al. In that case, the microphone 26 may be used as a feedback microphone to ensure that the desired attenuation of the noise is achieved. Also, in that case, if a purely feedback system is desired, the feedforward microphone 16 would not be used. The acoustic output signals from remaining resonators 121–124 will be time-delayed as discussed hereinbefore.

Figure 12:
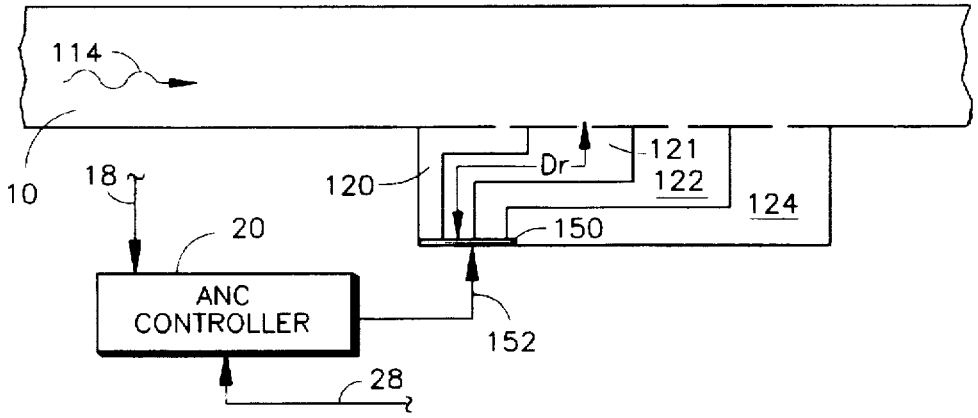
FIG. 12 is a side view of the phased-array active Helmholtz resonator active noise control system of FIG. 11 using a flat speaker, in accordance with the present invention.

Referring now to FIG. 12, alternatively, instead of utilizing a conventional speaker, a thin speaker 150 may be used if desired, such as SpeakerTape® or SpeakerTape ANC™ made by GMW SpeakerTape Corporation, of Vancouver, Canada (British Columbia). However, any thin acoustic actuator may be used for the thin speaker 150 if desired, such as a non-voice coil film actuator, e.g., PVDF, voided PVDF, electrostatic, piezoelectric, piezopolymer, piezoceramic, etc. The film actuator may operate in "thickness" actuation mode, where the thickness of the actuator varies to provide displacement, or "transverse" actuation mode, where displacement is achieved through bending motion.

When the thin speaker 150 is used, the walls between the four resonators 120,121,122,124 may each come close to or touch the surface of the thin speaker 150 which allows the resonators to be isolated from each other, thereby minimizing the cross-coupling of noise or anti-noise from one resonator to the next. Thus, the thin speaker 150 may have four separate strips of speakers (each strip extending into the page), each of which may be electrically connected together to a common electronic drive signal provided on a line 152 from the controller 20. Also, each strip may have a plurality of rows (into the page) of speakers all driven simultaneously.

Figure 13:
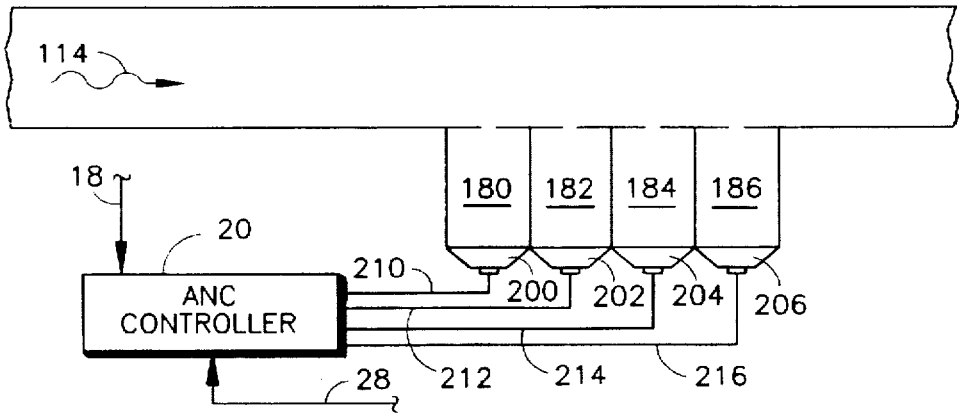
FIG. 13 is a side view of the phased-array active Helmholtz resonator active noise control system using electronic phasing, in accordance with the present invention.

Referring now to FIG. 13, instead of acoustically phasing some or all of the resonators using different resonator depths Dr as shown in FIGS. 10–12, some or all of the resonators in the array may have the same depth, as indicated by resonators 180–186, and be electronically time delayed by electronically driving separate speakers 200–206 with separate signals on lines 210–216 at different times from the controller 20. The electronic time delays may be implemented using digital or analog electronics or in software. Alternatively, the delay electronics may be placed at the speaker location allowing for a single line to exist from the controller to reduce wiring. Instead of using conventional speakers for the speakers 200–206, a thin speaker may be used, such as that discussed hereinbefore with FIG. 12, having separately addressable actuator sections for each of the resonators 120–124. Also, the system configuration may employ a combination of acoustic and electronic time delays to provide the desired noise cancellation.

The amount and kind of passive attenuation (resistive or reactive) used with the invention may be tailored to the application. In particular, the resistance of the orifices may be selected to provide the desired resistance and thus "Q" level for each resonator.

More specifically, the system may be designed with low resistance (high Q) to provide significant passive attenuation at or near the resonance frequency in the event of failure of the active system components. Alternatively, the system may be designed with a high resistance (low Q) design, thereby providing a broad band passive low Q attenuation. In that case, the system would be more absorptive and less reflective. For example, if low Q (broadband cancellation) resonators are used for each resonator, less active cancellation will occur at each resonator, but the system will provide substantial passive attenuation in the event the active components fail. In that case, more resonators (i.e., a longer treated length) may be required to provide the same amount of active noise cancellation than if high Q resonators are used.

Also, the holes (or orifices) may be covered by a facing sheet (not shown) such as a membrane, mesh, or other resistive material which allows or does not allow flow to enter the resonator, and which alters the resistance and/or reduces regenerated noise (caused by flow over rough surfaces). Such a facing sheet would alter the resonant frequency and Q value of the resonator in a known way. Further, the number of holes for each resonator may be any number (i.e., one or more) required to provide the desired operation.

Instead of using an array of Helmholtz resonators having orifices with predetermined areas, the invention will also work with an open cavity resonator or side-branch resonator (such as that shown in FIG. 2) having an opening covered by a porous facing sheet and/or a non-porous membrane which allows acoustic energy to pass through (or a "sheet-cavity absorber"). Further, the invention will work with any type of cavity resonator (even an open cavity resonator) provided the acoustic output signals from the resonators are time delayed as discussed hereinbefore.

Also, one or more of the resonators or portions thereof may be filled with a sound absorbing material, such as acoustic foam. In that case, the acoustic propagation speed in such resonators may be different from that in the duct and would need to be accounted for when designing the resonator size and array spacing.

By having a plurality of phased active resonators, the active noise control system performs better actively because the amount of active attenuation at a given noise frequency is no longer limited by overall resonator length. In fact, the amount of active attenuation of a given noise frequency actually increases with resonator array length, instead of decreasing (as in the prior art). Thus, the resonator length may be as long as desired.

The invention also improves passive resonator performance because the passive attenuation of the phased resonator array is proportional to the resonator length L, i.e., the resonator array behaves as a "point reacting" resonator (or liner) due to the acoustic isolation between the resonators.

Even though the invention has been described as being used in an air conditioning duct, it should be understood that the invention will work with any active noise control application, such as vehicle cabin (car, airplane, helicopter, elevator, etc.) or room noise control or others.

Although the invention has been described and illustrated with respect to the exemplary embodiments thereof, it should be understood by those skilled in the art that the foregoing and various other changes, omissions and additions may be made without departing from the spirit and scope of the invention.

I claim:

1. An active noise control system, comprising:

sensing means for detecting noise and for providing noise signals indicative of said noise;

noise control means responsive to said noise signals and for providing electronic anti-noise signals;

at least two interconnected active resonators;

actuator means responsive to said electronic anti-noise signals and disposed on said resonators for providing acoustic anti-noise signals into said resonators; and said resonators being disposed successively along the propagation direction of said noise and each providing anti-noise acoustic output signals having a time delay between output signals from said interconnected resonators wherein at least one of said resonators has a predetermined depth which provides said time delay and said time delay being substantially equal to the propagation time of said noise between said two resonators, such that each of said output signals attenuates a portion of said noise.

2. The active noise control system of claim 1 wherein at least one of said resonators comprises a Helmholtz resonator.

3. The active noise control system of claim 1 wherein said actuator means comprises a single acoustic actuator which provides said acoustic anti-noise signals to each of said resonators.

4. The active noise control system of claim 1 wherein each of said resonators has a plurality of orifices.

5. The active noise control system of claim 1 wherein a portion of said electronic anti-noise signals to said actuator means are time delayed.

6. The active noise control system of claim 1 wherein said actuator means comprises a non-voice coil film actuator having a plurality of actuation regions each region providing said acoustic anti-noise signals to predetermined ones of said resonators.

7. The active noise control system of claim 1 wherein said sensing means comprises a sensor disposed within said resonator for providing signals indicative of said noise at said sensor.

8. The active noise control system of claim 1 wherein at least one of said resonators has sound absorbing material therein.

9. An active noise control system as in claim 1 wherein each resonator has a resonance frequency and wherein said resonance frequency is the same for each of said resonators.

10. An active noise control system as in claim 1 wherein each resonator has at least one orifice and wherein said resonance frequency of said interconnected resonators is obtained by adjusting the size of the orifice.

11. The active noise control system of claim 4, wherein said anti-noise signals from all of the orifices of one of said resonators are in phase.

* * * * *

UNITED STATES PATENT AND TRADEMARK OFFICE

CERTIFICATE OF CORRECTION

PATENT NO : 5,778,081

DATED : July 7, 1998

INVENTOR(S) : William P. Patrick

It is certified that error appears in the above-identified patent and that said Letters Patent is hereby corrected as shown below:

On the Title Page, insert the name of the Assignee as follows:

--Assignee: United Technologies Corporation
Hartford, Conn.--

Signed and Sealed this

Sixth Day of April, 1999

*Attest:*

*Attesting Officer*

Q. TODD DICKINSON

*Acting Commissioner of Patents and Trademarks*